US005941177A

United States Patent [19]

Anderson

[11] Patent Number: 5,941,177

[45] Date of Patent: Aug. 24, 1999

[54] RECYCLABLE, HEAVY DUTY, LIGHTWEIGHT, MOISTURE RESISTANT CORRUGATED FIBERBOARD PALLET

[76] Inventor: Marvin Anderson, P.O. Box 85, Salinas, Calif. 93902

[21] Appl. No.: 09/083,850

[22] Filed: May 22, 1998

[51] Int. Cl.[6] ..... B65D 19/00

[52] U.S. Cl. ..... 108/51.3

[58] Field of Search ..... 108/51.3, 51.11, 108/56.3

[56] References Cited

U.S. PATENT DOCUMENTS

| | | | |
|---|---|---|---|
| 2,446,914 | 8/1948 | Fallert et al. | 108/51.3 |
| 2,741,361 | 4/1956 | Klein | 108/51.3 X |
| 3,952,672 | 4/1976 | Gordon et al. . | |
| 4,230,049 | 10/1980 | Horne | 108/51.3 X |
| 5,184,558 | 2/1993 | Wozniacki | 108/51.3 |
| 5,218,913 | 6/1993 | Winebarger et al. | 108/51.3 |
| 5,269,219 | 12/1993 | Juvik-Woods | 108/56.3 X |
| 5,285,731 | 2/1994 | McIntyre | 108/51.3 |
| 5,337,679 | 8/1994 | Moorman | 108/51.3 |
| 5,350,066 | 9/1994 | Mendoza et al. . | |
| 5,377,600 | 1/1995 | Speese et al. | 108/51.3 |
| 5,385,103 | 1/1995 | Juvik-Woods | 108/51.3 |
| 5,385,625 | 1/1995 | LaFreniere . | |
| 5,406,892 | 4/1995 | Kilpatrick et al. | 108/51.3 |
| 5,465,672 | 11/1995 | Boyse et al. | 108/51.3 |
| 5,473,995 | 12/1995 | Gottlieb | 108/51.3 |
| 5,528,994 | 6/1996 | Iseli | 108/51.3 |

*Primary Examiner*—Jose V. Chen

[57] ABSTRACT

A recyclable, heavy duty, lightweight, moisture resistant corrugated fiberboard pallet is provided for improved performance of a pallet in various commercial and industrial applications. All major components are made of double walled, corrugated fiberboard that has been laminated for moisture control, and are connected with adhesive. A top pallet assembly is composed of two rectangular support sheets and load sheet. Attached to the bottom of the pallet top assembly are a series of runners. Each runner is comprised of a single sheet of fiberboard, scored and folded so as to form a four-sheet thickness, comprised of eight walls of fiberboard with corrugation vertically placed, and providing superior crush resistance when supporting heavy loads. Attached to each runner is a runner brace. Each runner brace is scored and wraps around a runner, with excess fiberboard being used to connect the runner to the pallet top assembly. A pallet bottom is secured to the lower surfaces of the runner braces.

11 Claims, 7 Drawing Sheets

RECYCLABLE, HEAVY DUTY, LIGHTWEIGHT, MOISTURE RESISTANT CORRUGATED FIBERBOARD PALLET

BACKGROUND OF THE INVENTION

1. Field of the Invention

The present invention relates generally to shipping platforms, and more specifically, to a recyclable, heavy duty, lightweight, moisture resistant corrugated fiberboard pallets.

2. Description of the Related Art

Pallets are typically used to ship and store a wide variety of materials and products. Traditional wooden pallets are made from wood, are strong and easily stackable. However, wooden pallets do have several problems. First, they are relatively high priced. Second, they are designed to be used repeatedly, necessitating costly repairs when damaged. Third, they are heavy, increasing shipping freight charges, and placing additional strain on moving equipment, such as forklifts. Fourth, they are not easily recycled since the nails or staples must first be removed, and as a result wood pallets are usually dumped into already overflowing landfills. Fifth, they are expensive, awkward and time consuming to assemble requiring either expensive machinery or laborers to impute the nails or tacks. Sixth, they are a problem to transport after use. Other problems include a decreasing supply of readily available slow growing hardwood and insect infestation.

Attempting to address the problems associated with traditional wooden pallets, numerous pallet constructions, made predominantly of paperboard material, such as corrugated fiberboard, have been designed. Some examples of this type of pallet include U.S. Pat. No. 5,406,892, issued in the name of Kilpatrick, et al., U.S. Pat. No. 5,377,600, issued in the name of Speese et al., U.S. Pat. No. 5,355,812, issued in the name of Kilpatrick et al., U.S. Pat. No. 5,350,066, issued in the name of Mendoza et al., U.S. Pat. No. 5,337,679, issued in the name of Moorman, U.S. Pat. No. 5,218,913, issued in the name of Winebarger et al., U.S. Pat. No. 5,184,558, issued in the name of Wozniacki, and U.S. Pat. No. 3,952,672, issued in the name of Gordon, et al.

In general, these types of pallets are an improvement over the wood pallet in that they are of lighter weight and sell for less than traditional wooden pallets.

However, these corrugated paper board pallet constructions suffer from numerous problems. First, they lack sufficient strength for use in storage of traditional products in warehouses and other commercial and industrial applications. Pallets must be constructed of component parts, such as runners or beams, that enable the pallet to be stored without any support while loaded or being lifted in cantilever fashion on short forks of a fork lift.

Second, pallets must be usable in heavy load applications. To increase the strength of its component parts to ensure this, the runners and stringers have been made with complicated structures requiring expensive machinery to assemble and increasing the cost of production. Thus, the high speed assembly process necessary to ensure the cost effectiveness of corrugated paperboard pallets in heavy load applications is not present. Third, the pallets cannot be stacked as conveniently and securely as traditional wood pallets, thus requiring the payloads on the paperboard pallets to be reduced, thus increasing costs to transporters, retailers and inevitably the consumer. Fourth, the pallet constructions lack durability required to be used with forklifts. Non-wood pallets are particularly susceptible to sideways movements which can collapse the runners or actually separate a runner from the rest of the pallet and container system. If a fork lift engages the pallet runners at a wrong angle or with too much force, the pallet can collapse or otherwise be damaged beyond usefulness. Fifth, their use is severely limited by the fact that the pallets are not moisture resistant. Their structural integrity is compromised when the pallets are used near moisture, such as on docks, or when used to store products that may melt or release moisture before, during or after transport. Sixth, the pallet is not totally recyclable, thus necessitating that the pallet be placed in landfills when inevitable structural failure occurs.

No single device solves all the problems discussed above. As one problem is solved, another problem arises. For example, some devices attempt to solve the moisture, strength and durability problems by combining plastic and corrugated cardboard or other paper products in the pallet. The problem with this approach is that the pallet is not easily recyclable. The plastic and paperboard must be separated prior to recycling. In addition, these plastic and paper board pallets are expensive and difficult to manufacture and assemble.

Consequently, a need has been felt for an improved, recyclable, heavy duty, lightweight, moisture resistant corrugated fiberboard pallet that can be easily, efficiently, and cost effectively manufactured and assembled.

SUMMARY OF THE INVENTION

It is a general object of the present invention to provide an improved corrugated fiberboard pallet of unique design that is recyclable, lightweight, meets industry standards of strength and stability, is moisture resistant, and can be easily, efficiently, and cost effectively fabricated and assembled.

Another object of the present invention is to provide a corrugated fiberboard pallet that looks and functions like a conventional wooden pallet in both structure and performance. Additionally, it is an object of the present invention to provide a corrugated fiberboard pallet that is comprised of components that resemble corresponding components of conventional wooden pallets in both structure and performance.

Other objects of the present invention are to provide a corrugated fiberboard pallet of a paper based material that is both readily available and completely recyclable.

A further object of the present invention is to provide a corrugated fiberboard pallet design that can be manufactured on inexpensive equipment that is readily available within the paper industry.

Another object of the present invention is to provide a corrugated fiberboard pallet that includes fiberboard parts that are folded and wrapped in such a way as to eliminate flute exposure to moisture or insect contamination. Further, such folded and wrapped components include top deck runners and bottom stringers manufactured of laminated, corrugated fiberboard paper material.

It is the main feature of the present invention to provide such a wrap that secures the runner to the top deck and cover exposed flutes on the bottom of the runners as well as the edge exposed flutes on the top deck. The major benefit of such a feature is the reduction of moisture and insect contamination in a manner unanticipated anywhere in the designs of the relevant art.

Briefly described according to one preferred embodiment of the present invention, a pallet top assembly is provided which includes support sheets and a load sheet; runners, runner braces, a pallet bottom, laminate, and adhesive to secure the major components together. All major components are composed of double walled, corrugated fiberboard. The two support sheets are generally rectangular in shape and stacked vertically. The load sheet is positioned on top of the support sheets, is scored, and longitudinally overlaps the support sheets, forming the bottom surface of the pallet top assembly.

Attached to the lower surface of the pallet load sheet, which forms the bottom of the pallet top assembly, are a series of runners. The runners are equally spaced, longitudinally extending members that are horizontally parallel to each other and of equal height. Each runner is comprised of a single sheet of fiberboard, scored and folded so as to form a four-sheet thickness. Each runner, therefore, in the preferred embodiment, consists of eight-walled lateral thickness. This provides superior crush resistance when supporting heavy loads. It also increases strength and stability when lateral forces are exerted against the runners, as when a fork lift engages the pallet.

Attached to each runner is a runner brace. Each runner brace is scored and wraps around a runner, with the ends of the fiberboard being used to connect the runner to the pallet top assembly. A pallet bottom is secured to the lower surfaces of the runner braces.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1A:
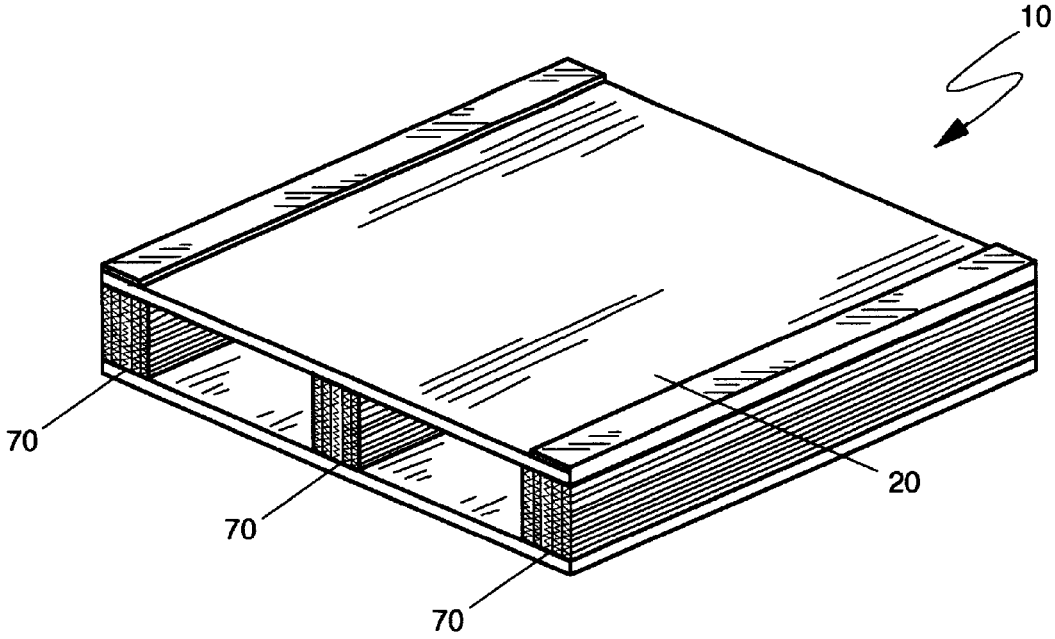
FIG. 1A is a top front perspective view of one preferred embodiment of a recyclable, heavy duty, lightweight, moisture resistant corrugated fiberboard pallet, shown herein in an assembled condition.
Figure 1B:
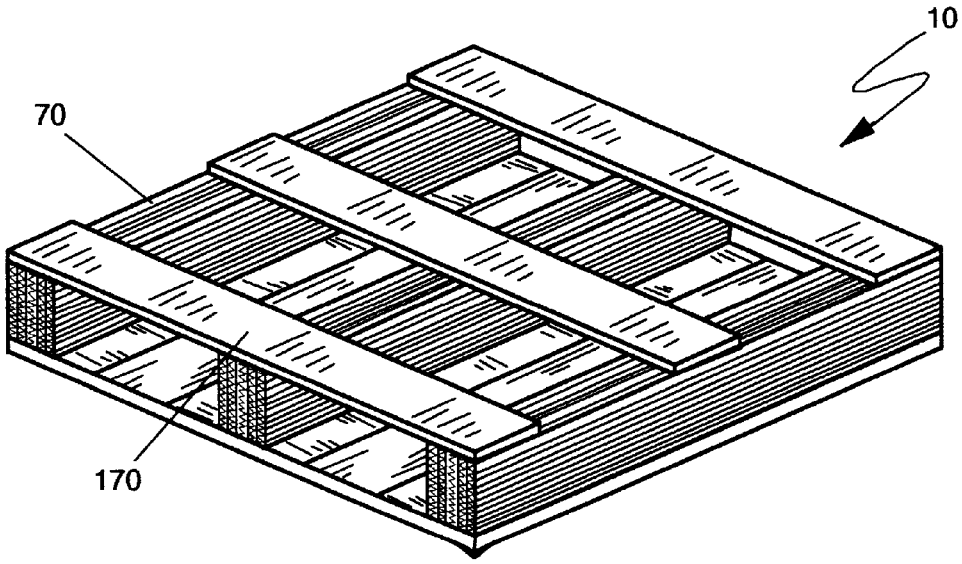
FIG. 1B is a bottom front perspective view thereof.
Figure 2:
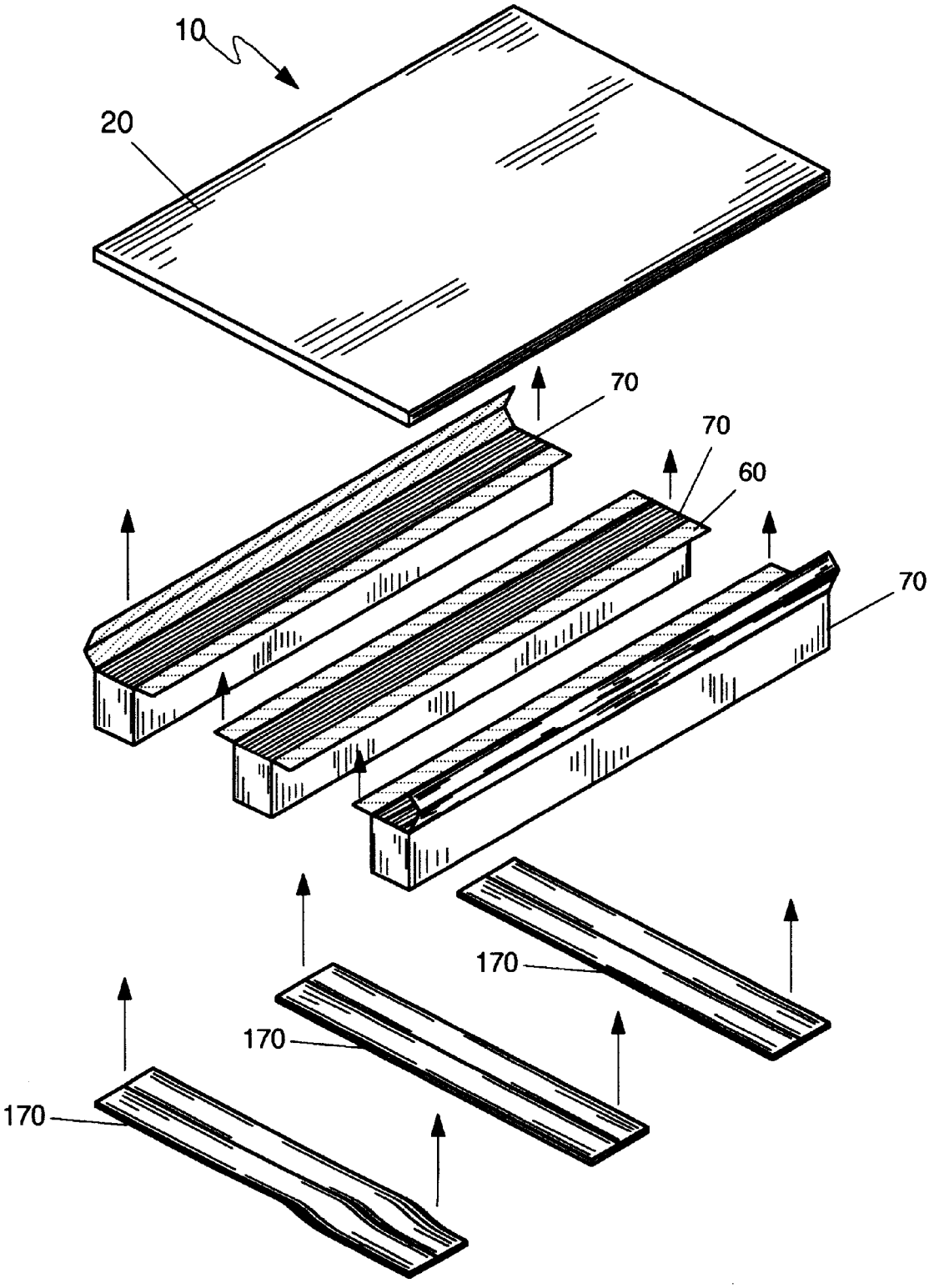
FIG. 2 is a front exploded perspective view thereof.

Referring now to the Figures, a first preferred embodiment of a recyclable, lightweight, moisture resistant, corrugated, fiberboard pallet 10 is disclosed, comprised of a pallet top assembly 20 mounted on top of a plurality of aligned runners 70. Each support sheet 30 is formed from a rectangular blank of a double walled, corrugated paperboard product, such as fiberboard, as will be described more fully below. Attached to the lower surface of the pallet top assembly 20, are a series of runners 70. This attachment is by any conventional attachment means 60, such as adhesive. The runners 70 are equally spaced, longitudinally extending members that are horizontally parallel to each other. The number and configuration of runners will vary, as will be shown. The height of the runners 70 is equal to each other, such that when the runners 70 are connected to the pallet top assembly 20, their upper and lower surfaces will be in parallel horizontal planes. As shown in FIG. 1B and FIG. 2, a plurality of pallet bottoms 170 are connected to the lower runner surface, bridging adjacent runners in a linear manner.

Figure 3A:
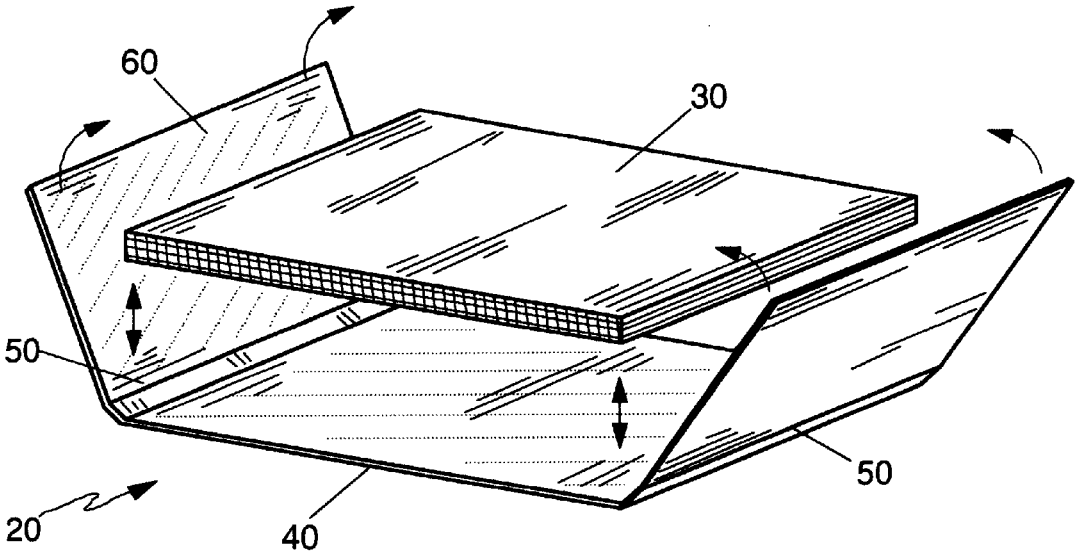
FIG. 3A, FIG. 3B, FIG. 3C are front perspective, exploded views of a top deck assembly for use with the preferred embodiments of the present invention shown in various stages of assembly.
Figure 3B:
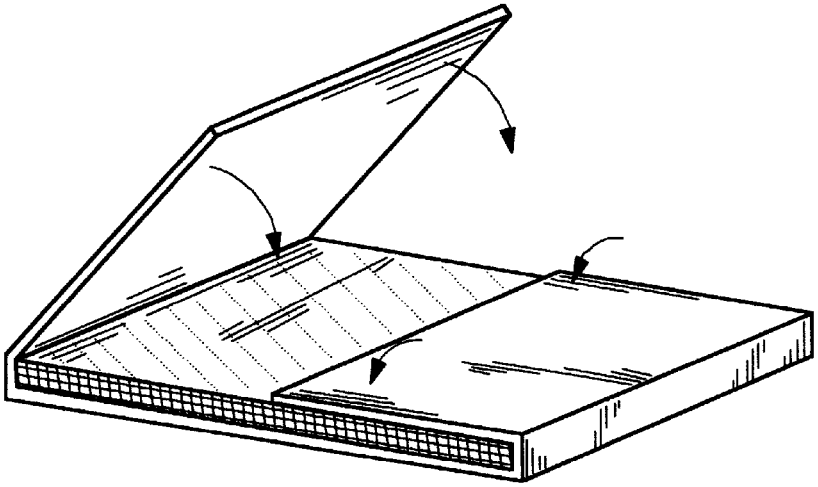
Figure 3C:
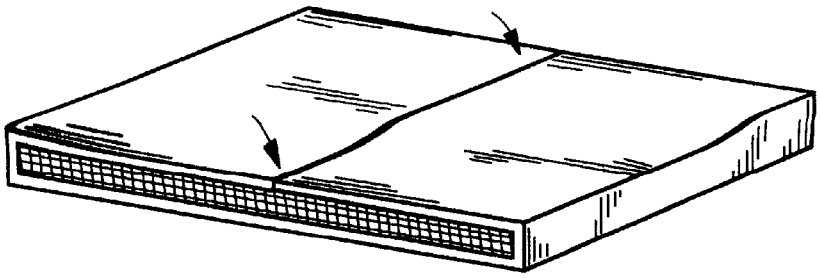

Similarly, a pallet top assembly 20 is mounted on top of a plurality of aligned runners 70. As shown in FIG. 3A through FIG. 3C, to accomplish this, the pallet top assembly 20 has a load sheet 40 encompassing a plurality of support sheets 30. The load sheet 40 extends longitudinally, beyond the ends of the support sheets 30 and is scored 50 laterally to allow the load sheet 40 to be folded laterally, positioning the load sheet 40 against the longitudinal ends of the support sheets 30 and underneath the support sheets 30, contacting the lower surface of the support sheets 30. This portion of the load sheet 40 forms and becomes the bottom surface of the pallet top assembly 20. The support sheets 30 are secured to each other and the load sheet 40 via an adhesive 60. Such a cross laminated corrugation method allows for tremendous compression strength and shear rigidity while remaining extremely lightweight. It is the main feature of the present invention to provide a load sheet 40 that wraps and covers the edge exposed flutes on the top deck. The major benefit of such a feature is the reduction of moisture and insect contamination to the cavities created by the flutes.

Figure 4A:
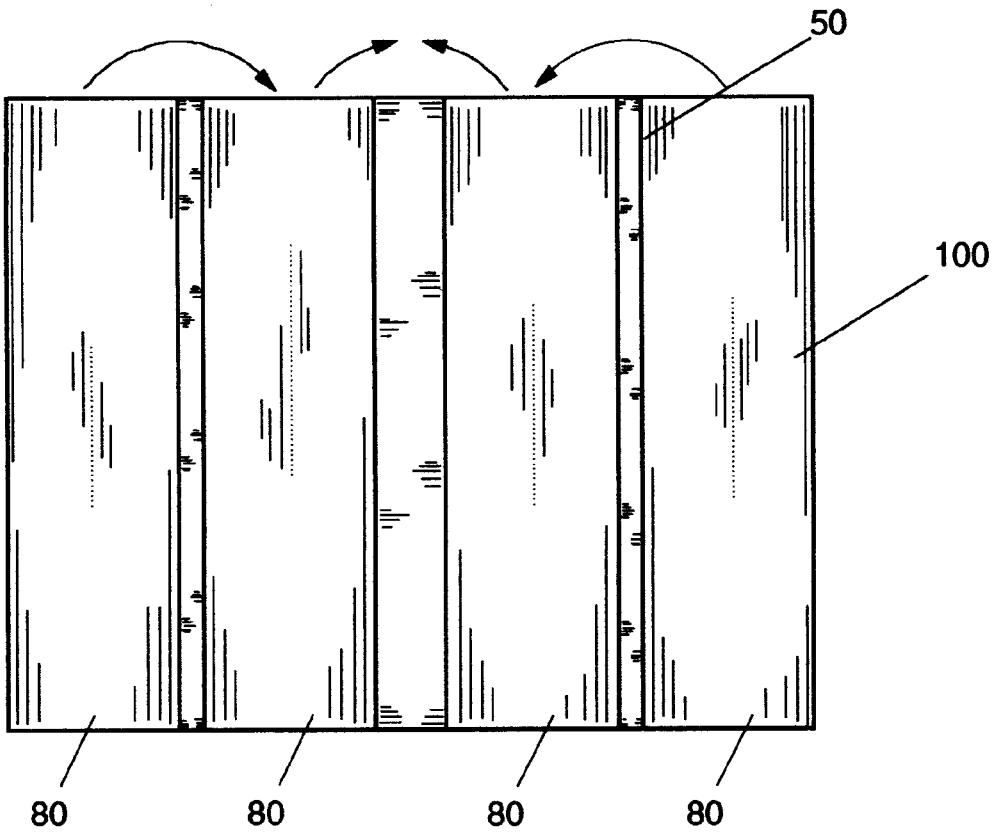
FIG. 4A, FIG. 4B, and FIG. 4C are a sequential illustration of a runner assembly 70 indicating sequential construction steps.
Figure 4B:
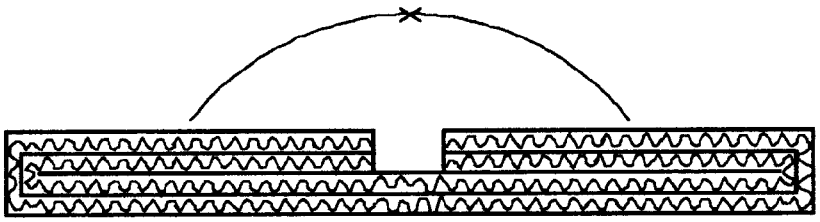
Figure 4C:
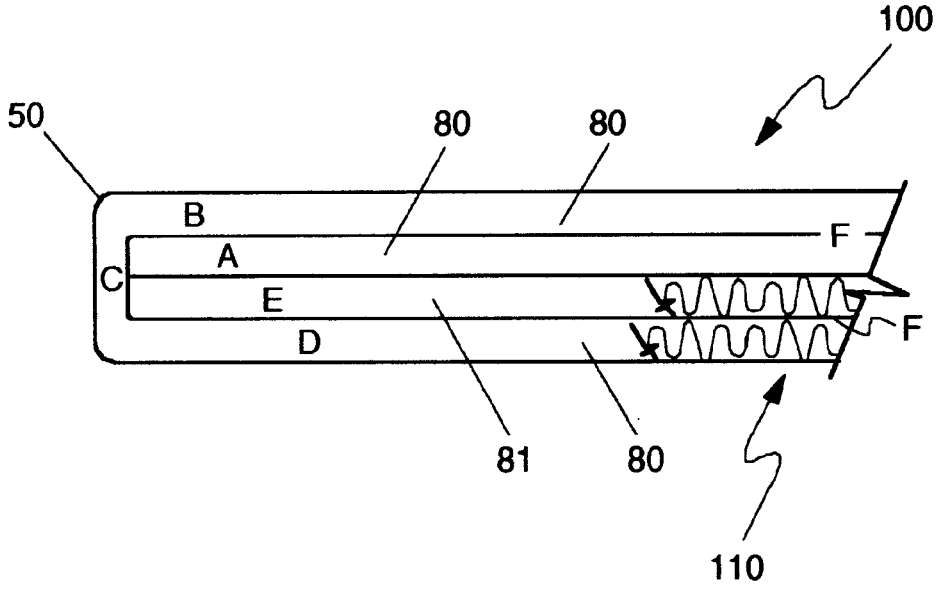

Referring now to FIG. 4A through FIG. 4C, the steps used to form each runner 70 are illustrated. The structural center rail of each runner 70 is composed of a rectangular blank of a corrugated, double walled paperboard product, such as fiberboard, formed into an interior runner panel 100. Each interior runner panel 100 is scored 50 longitudinally such that the runner panel 100 is divided into four runner panels 80 of equal longitude and latitude. Between the two outer runner panels, shown as "A" and "E" and the adjoining interior runner panel, shown as "B" and "D" is a scored section equal to the thickness of the fiberboard blank, shown as "F". Between the two interior runner panels "B" and "D" is a scored section "C" equal to twice the thickness of the fiberboard blank.

The two outer scored sections allow the exterior runner panels "A" and "E" to be folded onto the adjoining interior runner panel "B" and "D" respectively, such that the upper surface of each exterior runner panel 80 rests against the upper surface of the adjoining interior runner panel 80. FIG. 4B indicates the interior runner panel 100 in this state.

As shown in FIG. 4C, the runner panel 100 is then folded in half along the middle scored section "C", such that the lower surfaces of the two exterior runner panels 80 rest against each other, forming a runner 70 of four sheets of double walled fiberboard. The runner panels 80 may be secured by means of an adhesive 60, applied to the between all surfaces of the runner panels 80 that are in contact with each other as the runner 70 is assembled. It is envisioned in the preferred embodiment the corrugations of the fiberboard be aligned linearly along the length of the pallet runner 70, allowing only two ends with fluid communication to the interior flutes, indicated as 110 on FIG. 4C. A completed runner 70 is shown in FIG. 4D.

Figure 4D:
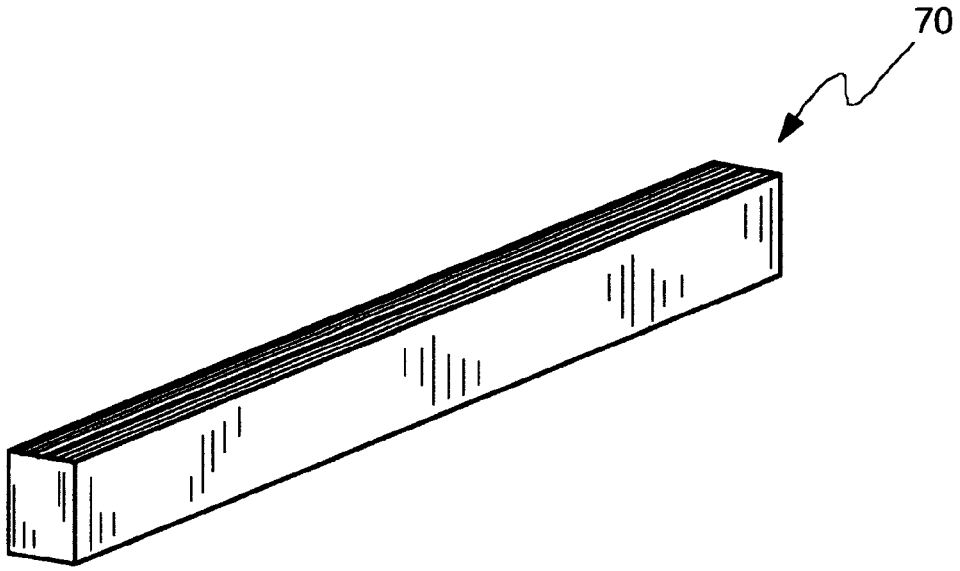
FIG. 4D is a perspective view of an assembled runner assembly 70 as formed by the process indicated in FIG. 4A through 4C.
Figure 5A:
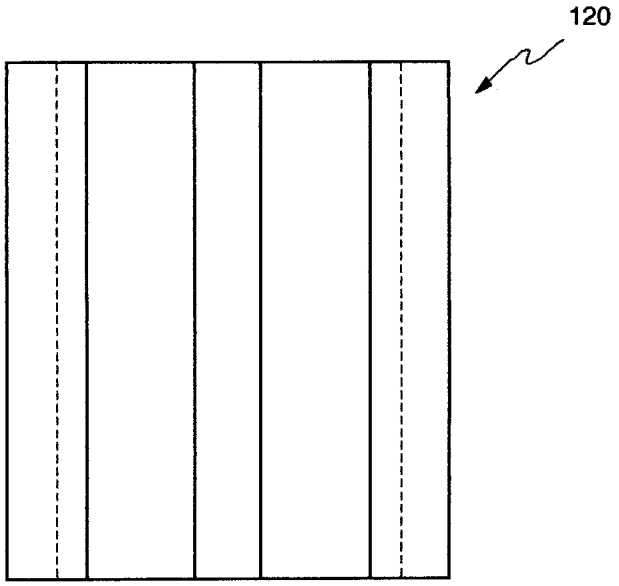
FIGS. 5A through 5D are a sequential illustration of a wrapped runner support.
Figure 5B:
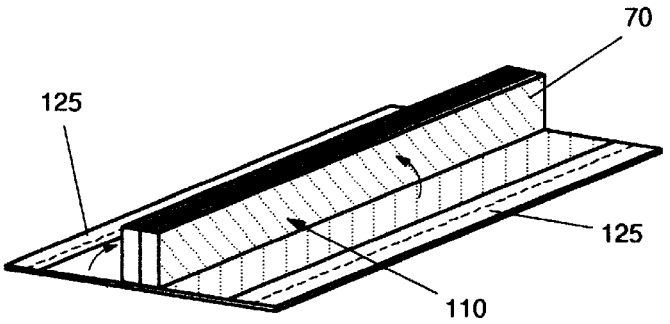
Figure 5C:
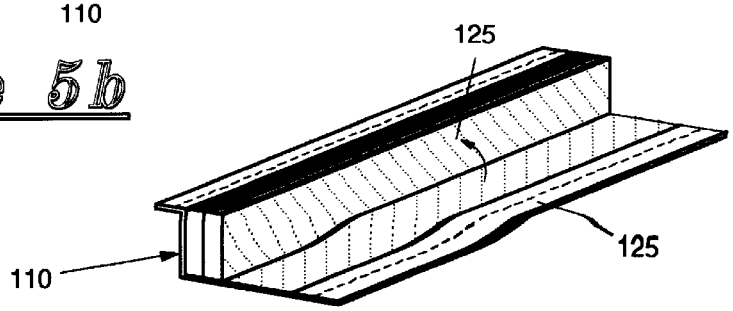
Figure 5D:
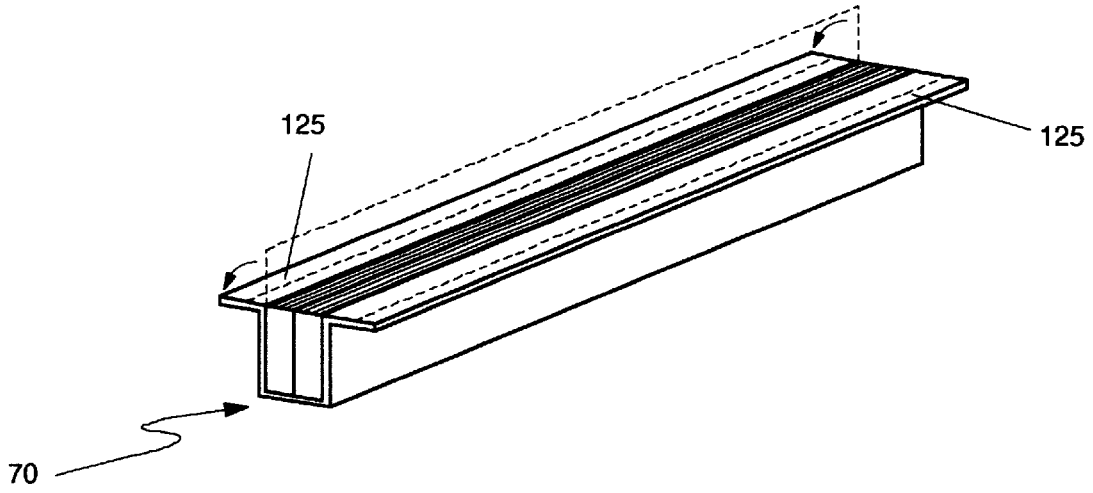

As shown in FIG. 5A through FIG. 5D, it is a main feature of the present invention to provide such a wrap 120 that secures the runner that was formed in FIG. 4D to the top deck and cover exposed flutes on the bottom of the runners as well as the edge exposed flutes on the top deck. The major benefit of such a feature is the reduction of moisture and insect contamination in a manner unanticipated anywhere in the designs of the relevant art. To accomplish this, the runner 70 is positioned such that the runner panel lower surfaces are in the vertical plane, and form the runner sidewalls 110. The excess material on the outer portion of the wrap 120 form a pair of flanges 125. The flanges 125 are then wrapped around and over the edges of the top deck 20, securing the pallet runners to the top deck while at the same time closing and sealing the exposed flutes on the edge of the top deck.

As can be envisioned by one skilled in the art in conjunction with the teachings of the present disclosure, many design permutations of the components of the present invention can be created in order to result in a recyclable, lightweight, moisture resistant, corrugated, fiberboard pallet of a type specifically designed to address the particular stacking, loading, and shipping needs of the user. For instance, the overall configuration and quantity can be adjusted to accommodate fork-lift access from two separate and opposite directions, or to allow various weight carrying or pallet stacking capabilities. Other variations are envisioned, and would mostly result in alternate runner configurations. Further, various level of longevity can be achieved by forming the double walled, corrugated fiberboard blanks, which comprise all the major components of the present invention, are pre-treated with a waterproofing substance, such as a laminate.

2. Operation of the Preferred Embodiment

To use the present invention, a forklift places its forks in the lift pallet slots which are created by the runners 70, the pallet top assembly 20, and the pallet bottom 170. The present invention is thereby fully utilized as a replacement for conventional hardwood pallet systems.

The foregoing description is included to illustrate the operation of the preferred embodiment and is not meant to limit the scope of the invention. As was described above, various configurations of the elements taught by the present disclosure can be manipulated to form pallets having various utility characteristics. Therefore, the scope of the invention is to be limited only by the following claims.

What is claimed is:

1. A recyclable, heavy duty, lightweight, moisture resistant corrugated fiberboard pallet, said pallet comprising:

a pallet top assembly having a bottom surface and at least two lateral ends, said pallet top assembly further comprised of two support sheets having at least two longitudinal ends, a lower surface, and an upper surface, said support sheets being generally rectangular in shape, stacked vertically, and formed from a rectangular blank of fiberboard, said fiberboard being lightweight, double walled, and corrugated;

a load sheet having a lower surface, said load sheet comprising part of said pallet top assembly, said load sheet being positioned on top of said support sheets, said load sheet being generally rectangular in shape, and formed from said rectangular blanks of fiberboard; said load sheets extending longitudinally, beyond said longitudinal ends of the said support sheets and scored laterally to allow said load sheet to be folded laterally, positioning said load sheet against said longitudinal ends of said support sheets and underneath said support sheets, contacting said lower surface of said support sheets, said load sheet becoming said bottom surface of said pallet top assembly, with said support sheets secured to each other and said load sheet via an adhesive;

a series of runners, said runners attached to said bottom surface of said pallet top assembly, said runners being equally spaced, longitudinally extending members that are horizontally parallel to each other and of equal height, and are composed of a rectangular blank of said fiberboard, with said fiberboard blank being folded such that said runner is the lateral thickness of four double walled fiberboard and said corrugation runs vertically;

a series of runner braces, said runner braces being generally rectangular in shape, and composed of said fiberboard, with said runner braces scored and wrapping around said runner, and connecting with said bottom surface of said pallet top assembly via said adhesive, with said runner braces positioned at the lateral ends of said top pallet assembly being folded upward beyond said support sheets and resting on said upper surface of said support sheets, between said support sheets and said load sheet;

a pallet bottom, said pallet bottom being composed of a rectangular blank of said fiberboard, and said pallet bottom being attached to lower surfaces of said runner braces via said adhesive;

laminate, said laminate applied to said load sheet, said support sheets, said runners, said runner braces, and said pallet bottom;

two pallet slots, said pallet slots being formed by said top pallet assembly, said runners and runner braces, and said pallet bottom.

2. The pallet described in claim 1, wherein said fiberboard blank that comprise said runners further comprises:

two external runner panels, said runner panels being of equal longitude and latitude;

two interior runner panels, such interior runner panels being of the same configuration and size as said exterior runner panel, each said interior runner panel being adjacent to both an exterior runner panel and an interior runner panel along opposed sides;

a series of scored sections, said scored sections positioned between said runner panels, said scored sections positioned between said exterior runner panels and adjacent said interior runner panels being of lateral distance equal to the thickness of said fiberboard, such as to facilitate the folding of the exterior runner panels on top of said internal runner panels; and a scored section positioned between said internal runner panels, said scored section lateral distance being equal to twice the thickness of said fiberboard, such that the folded said interior runner panels and said exterior runner panels can be folded and away from said scored sections and together to create said runner of lateral thickness equal to eight times the thickness of said fiberboard.

3. The runner described in claim 1, wherein said runner is folded such that said runner is the lateral thickness of four sheets of said fiberboard.

4. The runner described in claim 1, wherein said runner is positioned such that it is longitudinally elongated, with said corrugations running vertically.

5. The pallet described in claim 1, wherein more than two of said support sheets are used to increase vertical compression resistance.

6. The pallet described in claim 1, wherein said fiberboard blanks are of various sizes and allow for a variety of folds, such that said runners are composed of varying numbers of said runner panels, such that said runner has varying lateral thickness.

7. The pallet described in claim 1, further comprising an exterior runner brace panel on each said runner brace that rest at said lateral ends of said pallet top assembly, and wherein said exterior runner brace panels are folded upward and rest between said support sheets and said load sheet before said load sheet is wrapped around said support sheets, the components being secured by said adhesive.

8. A recyclable, lightweight, moisture resistant, corrugated, fiberboard pallet, said pallet comprising:

a pallet top assembly; and a plurality of aligned runners, each having a lower runner surface, and said runners affixed to the underside of said pallet top assembly and wherein each runner includes an internal fiberboard blank, and each runner is scored longitudinally such that the runner is divided into four runner panels of equal longitude and latitude, and between the two exterior runner panels and the adjoining interior runner panels is a scored section equal to the thickness of the fiberboard blank, and wherein two outer scored sections facilitate the folding of the exterior runner panels onto the adjoining interior runner panel and away from said scored section such that the upper surface of each exterior runner panel rests against the upper surface of the adjoining interior runner panel;

at least one of pallet bottoms connected to the lower runner surfaces, bridging adjacent runners in a linear manner;

and wherein said top assembly and said aligned runners are formed from a double walled, corrugated paperboard product.

9. The pallet of claim 8, wherein said runners are attached to the lower surface of the pallet top assembly by adhesive.

10. The pallet of claim 8, wherein said pallet top assembly comprises:

a plurality of support sheets; and a load sheet encompassing said plurality of support sheets, said load sheet extends longitudinally, beyond the ends of the support sheets and is scored laterally to allow the load sheet to be folded laterally, positioning the load sheet against the longitudinal ends of the support sheets and underneath the support sheets, contacting the lower surface of the support sheets, such that a portion of the load sheet forms and becomes the bottom surface of the pallet top assembly.

11. The pallet of claim 10, wherein said support sheets are secured to each other and the load sheet via an adhesive.

* * * * *